US006428067B1

(12) United States Patent
Barragan

(10) Patent No.: US 6,428,067 B1
(45) Date of Patent: Aug. 6, 2002

(54) GUTTER CLEANING TOOL

(76) Inventor: Francisco Barragan, 566 Colorado Ave., Aurora, IL (US) 60506

( * ) Notice: Subject to any disclaimer, the term of this patent is extended or adjusted under 35 U.S.C. 154(b) by 0 days.

(21) Appl. No.: 09/804,999

(22) Filed: Mar. 12, 2001

(51) Int. Cl.[7] ..... E04D 13/076
(52) U.S. Cl. ..... 294/19.1; 294/118; 15/236.04
(58) Field of Search ..... 294/19.1, 22, 50.8, 294/118; 15/236.04

(56) References Cited

U.S. PATENT DOCUMENTS 931,061 A * 8/1909 Hardy ..... 294/50.8
3,858,267 A * 1/1975 Swannie ..... 15/144.1
4,549,611 A * 10/1985 Mills ..... 111/99
D314,898 S * 2/1991 Rust ..... D8/51
5,513,889 A * 5/1996 Fithen et al. ..... 294/118
5,727,580 A * 3/1998 Patterson ..... 134/115 R

* cited by examiner

*Primary Examiner*—Dean J. Kramer
(74) *Attorney, Agent, or Firm*—Goldstein & Lavas, P.C.

(57) ABSTRACT

A gutter cleaning tool including a pair of elongated handles each having an upper end, a lower end, and an intermediate extent therebetween. The elongated handles are pivotally coupled together by a central pivot point whereby the elongated handles can move with respect to one another in a scissor-like arrangement. A pair of inverted L-shaped brackets are secured to the upper ends of the pair of elongated handles. A pair of plates are secured to the pair of inverted L-shaped brackets. The pair of plates are shaped to correspond with a cross-sectional shape of a gutter.

2 Claims, 3 Drawing Sheets

GUTTER CLEANING TOOL

BACKGROUND OF THE INVENTION

The present invention relates to a gutter cleaning tool and more particularly pertains to safely removing leaves and debris from gutters.

The use of cleaning instruments is known in the prior art. More specifically, cleaning instruments heretofore devised and utilized for the purpose of cleaning various items are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,447,927 to Malless, Jr. discloses a tool comprised of an elongated pole with a U-shaped scoop attachment for cleaning leaves and debris from an overhead gutter. U.S. Pat. No. 3,626,542 to Despain discloses a gutter cleaning tool comprised of a vertical elongated handle with a series of tines. U.S. Pat. No. 2,720,409 to Griffith and 2,817,867 to Bugbird disclose additional tools for reaching and cleaning elevated gutters.

While these devices fulfill their respective, particular objective and requirements, the aforementioned patents do not describe a gutter cleaning tool for safely removing leaves and debris from gutters.

In this respect, the gutter cleaning tool according to the present invention substantially departs from the conventional concepts and designs of the prior art, and in doing so provides an apparatus primarily developed for the purpose of safely removing leaves and debris from gutters.

Therefore, it can be appreciated that there exists a continuing need for a new and improved gutter cleaning tool which can be used for safely removing leaves and debris from gutters. In this regard, the present invention substantially fulfills this need.

SUMMARY OF THE INVENTION

In the view of the foregoing disadvantages inherent in the known types of cleaning instruments now present in the prior art, the present invention provides an improved gutter cleaning tool. As such, the general purpose of the present invention, which will be described subsequently in greater detail, is to provide a new and improved gutter cleaning tool which has all the advantages of the prior art and none of the disadvantages.

To attain this, the present invention essentially comprises a pair of elongated handles each having an upper end, a lower end, and an intermediate extent therebetween. The elongated handles are pivotally coupled together by a central pivot point whereby the elongated handles can move with respect to one another in a scissor-like arrangement. A pair of inverted L-shaped brackets are secured to the upper ends of the pair of elongated handles. The brackets each have a lower vertical portion and an upper horizontal portion. The lower vertical portion is secured to the upper end of the elongated handle. A pair of plates are secured to the pair of inverted L-shaped brackets. The pair of plates are shaped to correspond with a cross-sectional shape of a gutter. The pair of plates each have a linear upper edge, a linear lower edge, and opposed angularly oriented side edges. The linear upper edge is secured to the upper horizontal portion of the bracket. The side edges each have a plurality of undulations therein to conform to the shape of the gutter.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved gutter cleaning tool which has all the advantages of the prior art cleaning instruments and none of the disadvantages.

It is another object of the present invention to provide a new and improved gutter cleaning tool which may be easily and efficiently manufactured and marketed.

It is a further object of the present invention to provide a new and improved gutter cleaning tool which is of durable and reliable construction.

An even further object of the present invention is to provide a new and improved gutter cleaning tool which is susceptible of a low cost of manufacture with regard to both materials and labor, and which accordingly is then susceptible of low prices of sale to the consuming public, thereby making such a gutter cleaning tool economically available to the buying public.

Even still another object of the present invention is to provide a new and improved gutter cleaning tool for safely removing leaves and debris from gutters.

Lastly, it is an object of the present invention to provide a new and improved gutter cleaning tool including a pair of elongated handles each having an upper end, a lower end, and an intermediate extent therebetween. The elongated handles are pivotally coupled together by a central pivot point whereby the elongated handles can move with respect to one another in a scissor-like arrangement. A pair of inverted L-shaped brackets are secured to the upper ends of the pair of elongated handles. A pair of plates are secured to the pair of inverted L-shaped brackets. The pair of plates are shaped to correspond with a cross-sectional shape of a gutter.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through t e various figures.

DESCRIPTION OF THE PREFERRED EMBODIMENT

Figure 1:
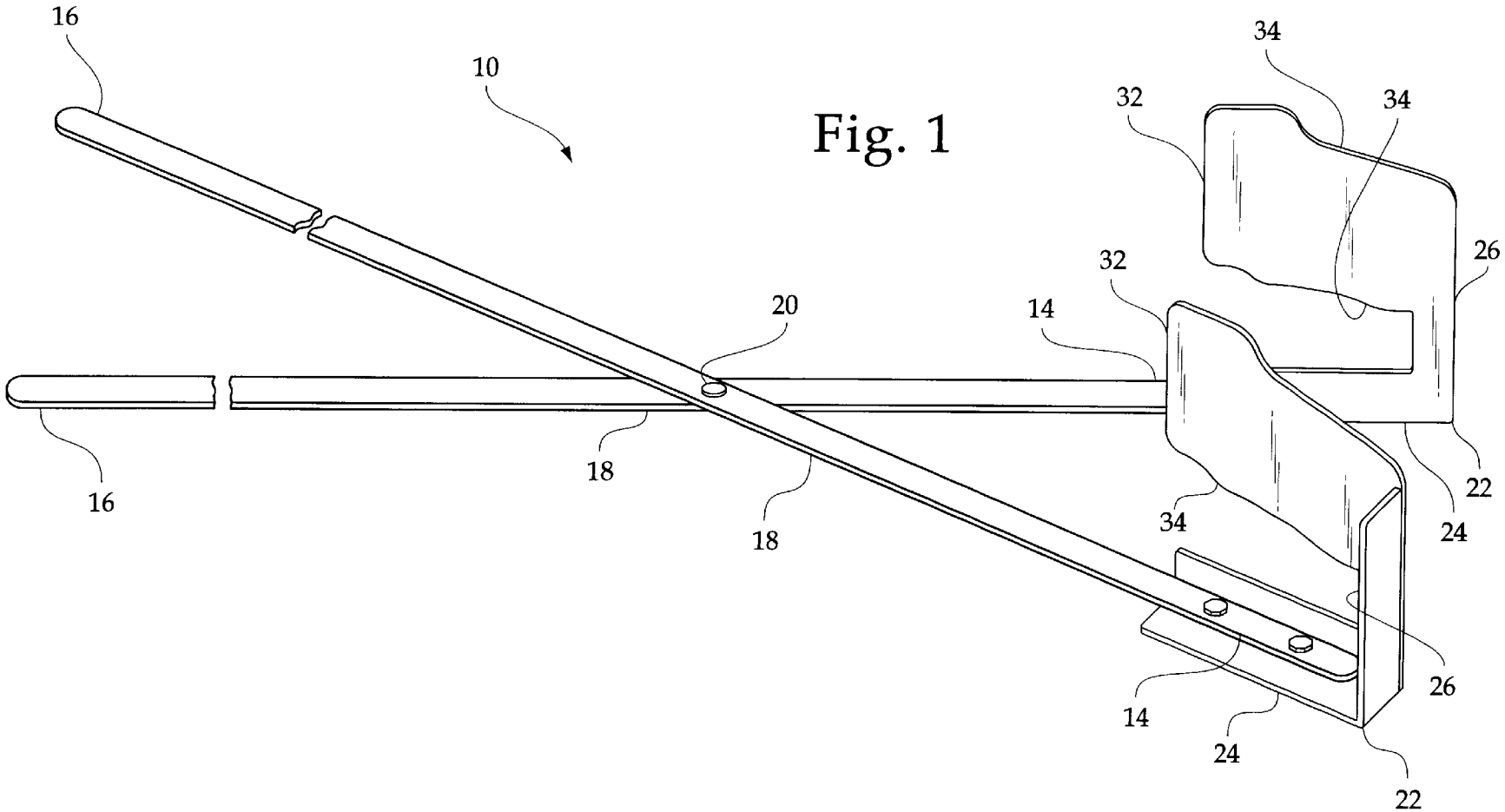
FIG. 1 is a perspective view of the preferred embodiment of the gutter cleaning tool constructed in accordance with the principles of the present invention.
Figure 2:
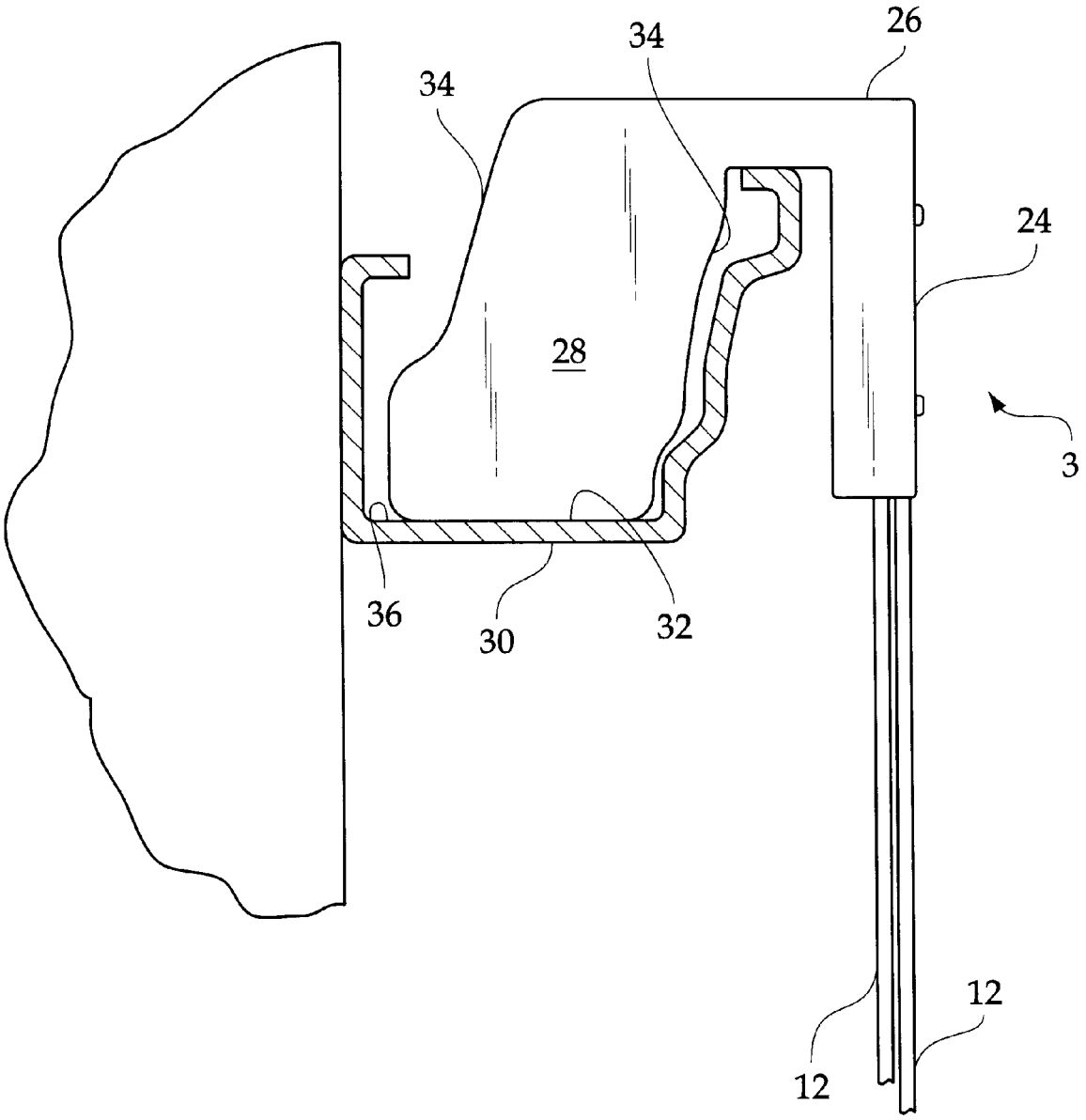
FIG. 2 is a side view of the present invention illustrated in use.

With reference now to the drawings, and in particular, to FIGS. 1 through four thereof, the preferred embodiment of the new and improved gutter cleaning tool embodying the principles and concepts of the present invention and generally designated by the reference number 10 will be described.

Specifically, it will be noted in the various Figures that the device relates to a gutter cleaning tool for safely removing leaves and debris from gutters. In its broadest context, the device consists of a pair of elongated handles, a pair of inverted L-shaped brackets, and a pair of plates. Such components are individually configured and correlated with respect to each other so as to attain the desired objective.

The pair of elongated handles 12 each have an upper end 14, a lower end 16, and an intermediate extent 18 therebetween. The elongated handles 12 are pivotally coupled together by a central pivot point 20 whereby the elongated handles 12 can move with respect to one another in a scissor-like arrangement.

The pair of inverted L-shaped brackets 22 are secured to the upper ends 14 of the pair of elongated handles 12. The brackets 22 each have a lower vertical portion 24 and an upper horizontal portion 26. The lower vertical portion 24 is secured to the upper end 14 of the elongated handle 12.

The pair of plates 28 are secured to the pair of inverted L-shaped brackets 22. The pair of plates 28 are shaped to correspond with a cross-sectional shape of a gutter 30. The pair of plates 28 each have a linear upper edge, a linear lower edge 32, and opposed angularly oriented side edges 34. The linear upper edge is secured to the upper horizontal portion 26 of the bracket 22. The side edges 34 each have a plurality of undulations therein to conform to the shape of the gutter 30.

Figure 3:
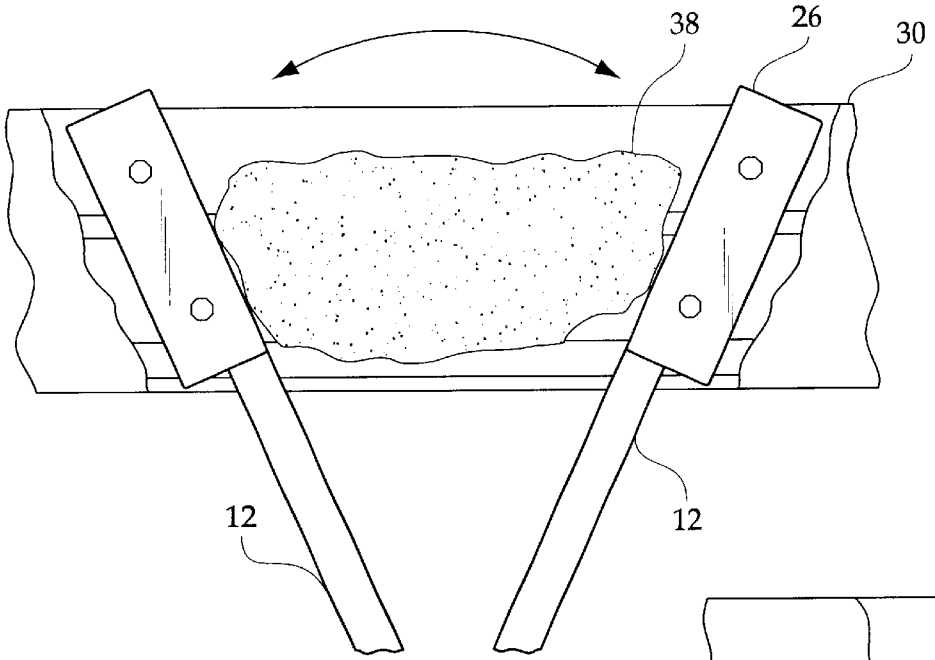
FIG. 3 is a front view of the present invention illustrated in use.
Figure 4:
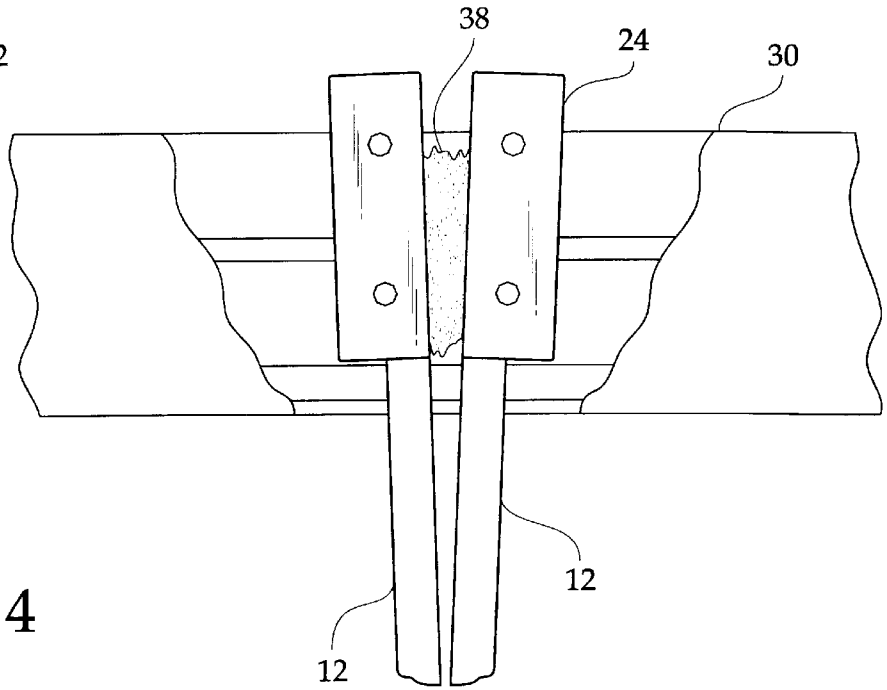
FIG. 4 is a front view of the present invention illustrated in use.

In use, a person positions the pair of plates 28 within the gutter 30 with the lower edges 32 positioned in an abutting relationship with a closed bottom 36 of the gutter 30. Note figure two. The person then moves the lower ends 16 of the elongated handles 12 apart so that the pair of plates 28 are positioned apart from one another. Note FIG. 3. The person then moves the lower ends 16 together, causing the pair of plates 28 to move inwardly together, essentially sandwiching any leaves and debris 38 between the plates 28. Note FIG. 4. The person then lifts upwardly on the elongated handles 12 to remove the plate's 28 from the gutter 30 so that the collected debris 38 could be discarded in the proper receptacle. The process can then be repeated at another stretch of the gutter 30.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A gutter cleaning tool for safely removing leaves and debris from gutters comprising, in combination:

a pair of elongated handles each having an upper end, a lower end, and an intermediate extent therebetween, the elongated handles being pivotally coupled together by a central pivot point whereby the elongated handles can move with respect to one another in a scissor-like arrangement;

a pair of inverted L-shaped brackets secured to the upper ends of the pair of elongated handles, the brackets each having a lower vertical portion and an upper horizontal portion, the lower vertical portion secured to the upper end of the elongated handle; and a pair of plates secured to the pair of inverted L-shaped brackets, the pair of plates being shaped to correspond with a cross-sectional shape of a gutter, the pair of plates each having a linear upper edge, a linear lower edge, and opposed angularly oriented side edges, the linear upper edge secured to the upper horizontal portion of the bracket, the side edges each having a plurality of undulations therein to conform to the shape of the gutter.

2. A gutter cleaning tool for safely removing leaves and debris from gutters comprising, in combination:

a pair of elongated handles each having an upper end, a lower end, and an intermediate extent therebetween, the elongated handles being pivotally coupled together by a central pivot point whereby the elongated handles can move with respect to one another in a scissor-like arrangement;

a pair of inverted L-shaped brackets secured to the upper ends of the pair of elongated handles; and a pair of plates secured to the pair of inverted L-shaped brackets, the pair of plates being shaped to correspond with a cross-sectional shape of a gutter, said plates each have a linear upper edge, a linear lower edge, and opposed angularly oriented side edges, the linear upper edge secured to the bracket, the side edges each having a plurality of undulations therein to conform to the shape of the gutter.

* * * * *